US005704341A

United States Patent [19]

Ritzenthaler

[11] Patent Number: 5,704,341

[45] Date of Patent: Jan. 6, 1998

[54] TENSION BAND FOR TRAP MACHINES

[75] Inventor: Thomas B. Ritzenthaler, Sandusky, Ohio

[73] Assignee: Ritz/Universal Band, Inc., Sandusky, Ohio

[21] Appl. No.: 685,751

[22] Filed: Jul. 24, 1996

[51] Int. Cl.[6] ..... F41J 9/18; F41B 7/00

[52] U.S. Cl. ..... 124/8; 124/17; 124/80; 267/153

[58] Field of Search ..... 124/1, 7, 8, 17, 124/80; 267/73, 74, 153

[56] References Cited

U.S. PATENT DOCUMENTS

| | | | |
|---|---|---|---|
| 228,959 | 6/1880 | Warne | 124/7 |
| D. 266,784 | 11/1982 | Sexton | D22/99 |
| 307,149 | 10/1884 | Bandle | 124/7 |
| D. 315,934 | 4/1991 | Wilson et al. | D21/191 |
| D. 315,935 | 4/1991 | Wilson et al. | D21/191 |
| D. 315,936 | 4/1991 | Wilson et al. | D21/191 |
| 372,136 | 10/1887 | Fouts | 124/7 |
| 783,523 | 2/1905 | Hoffman | 124/7 |
| 1,384,046 | 7/1921 | Cartino | 124/7 |
| 1,642,602 | 9/1927 | Constantinesco | 267/73 |
| 1,785,876 | 12/1930 | Pilates | 273/324 |
| 2,080,958 | 5/1937 | Beasley et al. | 124/7 |
| 3,221,726 | 12/1965 | Walker, Jr. | 124/7 |
| 3,549,143 | 12/1970 | Gilliam | 267/74 |
| 3,588,008 | 6/1971 | Wyman | 267/153 X |
| 3,601,112 | 8/1971 | Dale | 124/8 |
| 3,695,247 | 10/1972 | Tucker et al. | 124/17 |
| 3,794,325 | 2/1974 | Stender | 273/399 |
| 3,937,203 | 2/1976 | Riedmueller et al. | 124/8 |
| 3,971,357 | 7/1976 | LaPorte et al. | 124/8 |
| 4,481,932 | 11/1984 | Olson | 124/8 |
| 4,573,842 | 3/1986 | Mantela et al. | 267/153 X |
| 4,699,116 | 10/1987 | Freeland et al. | 124/7 |
| 4,749,286 | 6/1988 | White | 384/125 |
| 4,860,717 | 8/1989 | Powell et al. | 124/7 |
| 4,976,249 | 12/1990 | Gagnon | 124/8 |
| 5,387,171 | 2/1995 | Casey et al. | 482/130 |
| 5,458,555 | 10/1995 | Ko | 482/126 |

*Primary Examiner*—John A. Ricci
*Attorney, Agent, or Firm*—Head, Johnson & Kachigian

[57] ABSTRACT

A tension band comprising a generally rectangular mass of rubber or other suitable elastomeric material for use in lieu of a spring in conventional trap machines. Each end of the band is tapered and has a curvilinear central concave portion. A mounting hole lies adjacent to the central concave portion. The band has a centrally located longitudinal slot extending between the mounting holes. It is also provided with a pair of bushings which are seated in the mounting holes. Each bushing has a bore extending therethrough and is made of a hard plastic material. The diameter of the bushing is larger than that of the bore, such that the bore can be drilled out and enlarged if required.

10 Claims, 4 Drawing Sheets

TENSION BAND FOR TRAP MACHINES

BACKGROUND OF THE INVENTION

1. Technical Field

The present invention relates generally to devices for throwing aerial targets, and, more specifically, to a tension band for providing a propelling force to the throw arm of such a device.

2. Background

Sportsmen have long used inanimate aerial targets to hone their shooting skills. The most typical target is saucer-shaped and made of baked clay. This type of target is commonly referred to as a clay pigeon or bird.

The clay pigeon is usually thrown from what is called a "trap". The trap imparts a propulsive force to the clay pigeon, along with a tight spin to gyroscopically stabilize the target, hurling it through the air some 50 yards or more. The shooter, taking into account the speed and trajectory of the target, among other factors, attempts to break the flying target. Skeet, trapshooting and sporting clays contests, all involving the tossing and shooting of clay targets, continue to grow in popularity.

Numerous styles of traps are used to throw clay pigeons, the most typical having a throw arm tensioned by a spring. The spring is extended when the throw arm is "cocked". When the cocked throw arm is released or triggered, it swings in response to the contraction of the spring. Examples of spring loaded trap machines include those disclosed in U.S. Pat. Nos. 3,601,112; 3,971,357; 4,481,932; 4,699,116; 4,976,249 and Des. Pat. No. 266,784, which disclosures are incorporated herein by reference.

Though spring loaded trap machines effectively throw clay pigeons, using a spring tensioned throw arm does have drawbacks. The vibration caused by the forceful contraction of the spring leads to the fatigue of component parts and the premature breaking of a significant number of targets. The throw arm of a spring loaded trap machine is cocked from a twelve o'clock position to a six o'clock position. When the throw arm is triggered, most of the energy from the contraction of the spring is released between the six o'clock and four o'clock positions. The spring is generally completely relaxed at the three o'clock position. A violent vibration throughout the trap occurs when the spring coils come together. Even if a target is not broken by the vibration caused by the spring, the vibration may cause the target to wobble or otherwise have an uneven or erratic flight path.

The springs themselves are also subject to breaking. When this occurs, other components of the trap may be severely damaged. More importantly, trap personnel may be injured by flying metal parts.

In addition, it is often difficult and time consumming to adjust the tension on a spring loaded trap machine to alter the throw distance and speed of the target, and, for those machines requiring a manual setting, repeated cocking of the throw arm is demanding and tiresome.

Important to the advanced or competitive shooter, the noise created by a spring loaded machine tips the shooter off that the trap has been sprung. Special listening devices are sometimes used by a shooter to gain an advantage over others.

It is thus an object of the present invention to provide an alternative to the use of a spring for tensioning the throw arm of a trap machine.

It is a related object of the invention to reduce the vibration associated with spring loaded trap machines and diminish the danger attendant to operating powerful trap machines.

It is a further object to provide a clay target launching technology for easier, quieter trap operation, the technology being universally adaptable to spring loaded trap machines of various makes and models such that the machines can be quickly and inexpensively converted to the improved alternative.

SUMMARY OF THE INVENTION

The present invention comprises a tension band for use in lieu of a tensioning spring. The band has a special shape that gives it outstanding performance characteristics. The invention disclosed and claimed herein encompasses the configuration of the tension band as opposed to its composition.

More specifically, the tension band comprises a generally rectangular mass of rubber or other suitable elastomeric material. The band has a first long edge, a second long edge, a longitudinal axis and two integral end segments. Each end segment is tapered toward the longitudinal axis of the band and has a curvilinear central concave portion. A mounting hole is adjacent to the central concave portion.

In the most preferred embodiment, the band has a centrally located longitudinal slot extending between the mounting holes. It is also provided with a pair of bushings which are seated in the mounting holes. Each bushing has a bore extending therethrough and is made of a hard plastic material. The diameter of the bushing is significantly larger than that of the bore, such that the bore can be drilled out and enlarged if required.

The novel shape of the device allows it to generate immense thrust without overly stressing the mounting holes or damaging the bushings.

The tension band is operatively connected to known spring loaded trap machines using ordinary mounting hardware. The spring of the standard machine is completely removed and one or more tension bands are installed in its place. The tension band(s) and associated adaptive hardware comprise a launching system that can be offered as a kit for converting a spring loaded trap machine into a band operated device.

Traps machines utilizing the present invention are much less violent than spring loaded machines. When using a tension band, cocking the throw arm from the twelve o'clock position to the six o'clock position takes less effort, and, once released, the energy from the contraction of the band builds throughout the range of motion of the throw arm. Almost all of the energy generated by the contraction of the band is released from the two o'clock position to the twelve o'clock position. This results in a profound reduction in vibration, lessening the fatigue of component parts and decreasing the incidence of premature target breakage. This translates, in turn, into cost savings for the trap operator through longer trap life and lower target expense. Reducing the vibration associated with the launching of the target also results in a smoother target flight.

If a tension band of the present invention should happen to break, there is less likelihood that either the machine or its operator will be damaged or injured. Both sides of the band would have to snap in order for there to be a complete separation of the band, and the band has no metal parts. Moreover, since the band starts out slow and builds up speed there is less chance that a target will be launched prematurely.

The tension band is also easy to adjust and takes less effort to use. Two or more tension bands can be used in tandem to provide the desired amount of force to the throw arm. And despite its easy cocking quality, the tension band offers a tremendous amount of thrust to the throw arm. Tension band operated machines are also much quieter as compared to spring loaded machines, making it difficult for shooters to audibly detect the launch of a target.

In addition, owing to the use of bushings that can be drilled out and enlarged the tension band is universally adaptable to different makes and models of spring loaded trap machines.

A better understanding of the invention and its objects and advantages will become apparent to those skilled in this art from the following detailed description, taken in conjunction with the attached drawings, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description should be regarded as illustrative in nature and not as restrictive.

DETAILED DESCRIPTION OF THE PREFERRED EMBODIMENT

Figure 1:
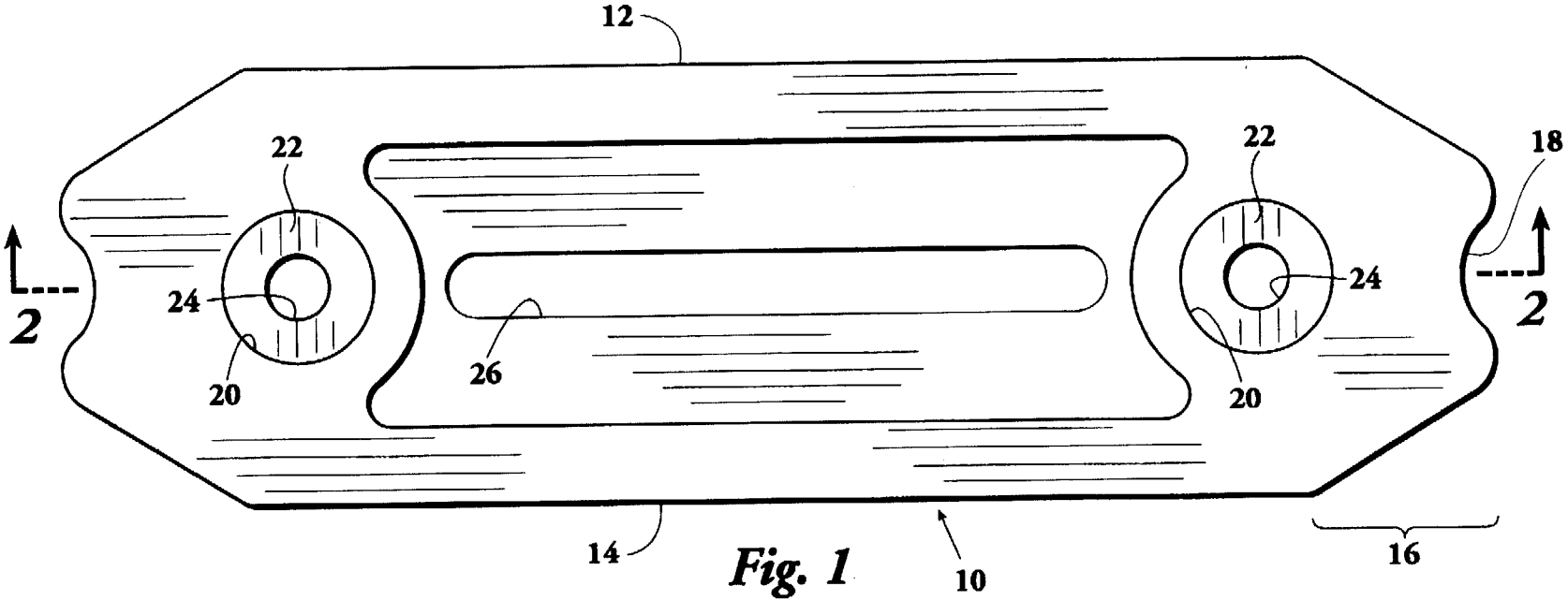
FIG. 1 is an elevational view of the preferred tension band.
Figure 2:
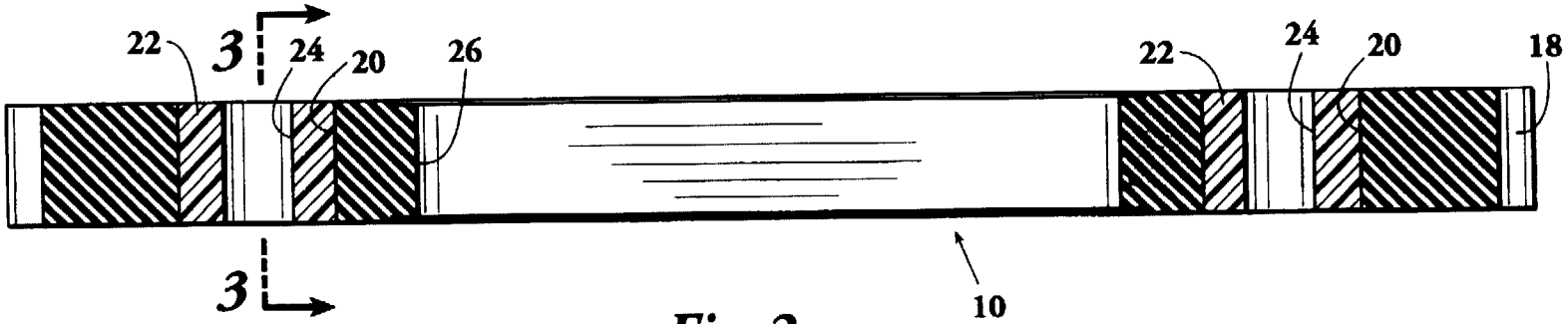
FIG. 2 is a cross sectional view taken along the longitudinal axis of the tension band as indicated by line 2—2 of FIG. 1.
Figure 3:
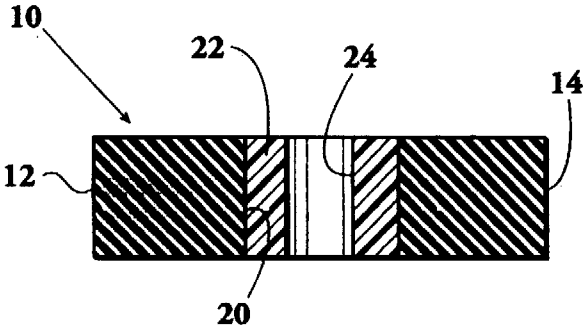
FIG. 3 is a cross sectional view taken along line 3—3 of FIG. 2.

Referring initially to FIGS. 1–3, the configuration of the preferred tension band, indicated by the reference numeral 10, is illustrated in detail. The band 10 is of a generally rectangular shape. It has a first long straight edge 12 and a second long straight edge 14. At each end of the band 10 the edges 12, 14 taper toward the longitudinal axis of the band 10 to form an integral end segment 16. The terminal end of each of the short, straight tapered lengths of the edges 12, 14 bends back toward the longitudinal axis of the band 10 to join its opposing edge and form a central curvilinear concave end portion 18.

The band 10 is elastic and made of rubber or any of the various elastic substances (elastomers) resembling rubber. Potential energy is generated by the stretching of the band 10, the energy being released upon the triggered contraction of the band 10. The elastic force generated by the stretch and release of the band 10 is dependent upon the length and thickness of the band 10. Accordingly, bands of the same general shape but with different lengths or thicknesses can be used to provide various elastic forces.

A mounting or attachment hole 20 centered along the longitudinal axis of the band 10 lies adjacent to each concave end portion 18. The mounting holes 20, together with conventional mounting hardware, are used to operatively connect the band 10 to the trap machine as described hereinbelow. Preferably, a pair of bushings 22 are seated in the mounting holes 20. Hard plastic or nylon bushings are favored. Each bushing 22 has a cylindrical bore 24 extending therethrough for accepting mounting hardware. The bore 24 is centered along the longitudinal axis of the band 10. The use of the bushings 22 reduces the stress and wear upon the edges of the mounting holes 20 caused by the stretching of the band 10, as more fully discussed in relation to FIG. 4, and further allows for the universal use of the band 10 with different types and sizes of mounting hardware. Each bushing 22 is of a diameter significantly larger than that of the standard bore 24, such that the bore 24 can be drilled out and enlarged in order to accept hardware required for the conversion of different makes and models of trap machines.

The preferred band 10 also has a central longitudinal slot or aperture 26 located between the bushings 22.

Figure 4:
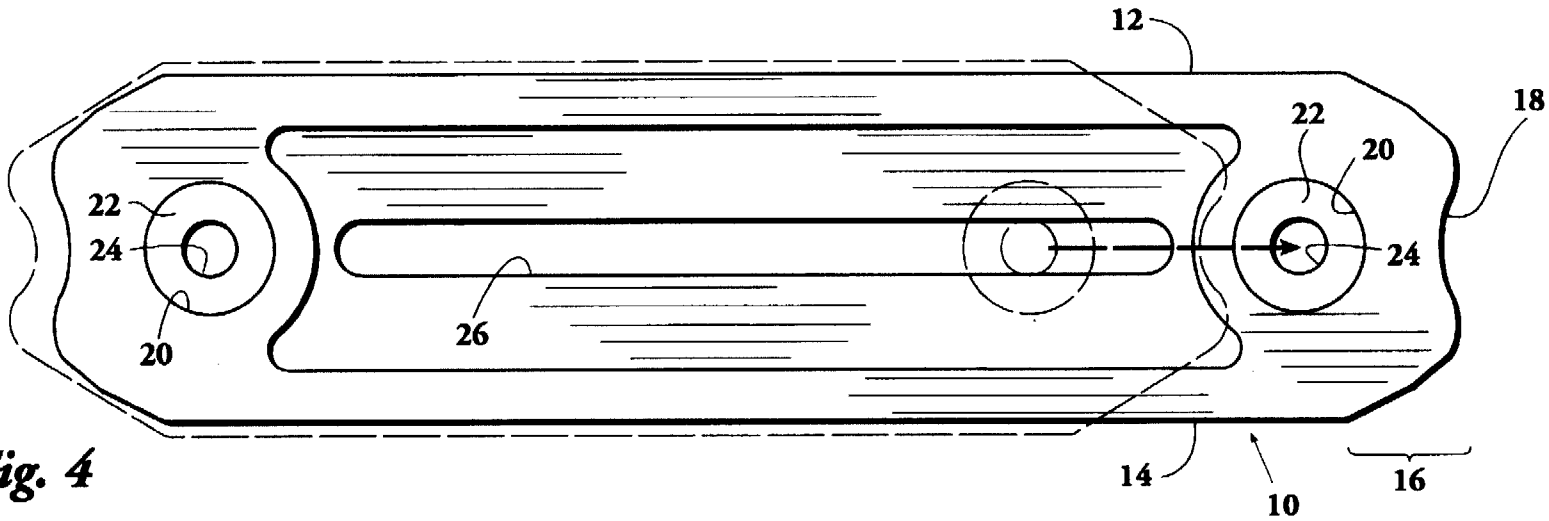
FIG. 4 is a comparison view contrasting the preferred tension band when in a contracted or resting state (phantom lines) with the band when in an extended or stretched state (solid lines).

Turning now to FIG. 4, the advantages of the unique shape of the tension band 10 can be appreciated. It is evident that when the band 10 is extended or stretched the short tapered edges of the end segment 16 flex upward away from the longitudinal axis of the band 10 and the concave end portion 18 pulls out and is flattened somewhat. Of course, the degree to which the short edges flex and the concave end portion 18 is flattened depends upon the length of the stretch. This "give" helps prevent the bushing 22 from pulling away from the edge of the mounting hole 20 on the side opposite the direction of force. Without such action, the bushing 22 will separate from the back edge of the mounting hole 20 leading to additional wear and the possible dislodging of the bushing 22 from the mounting hole 20.

The dimensions of the band 10, such as length and thickness, can be varied in order to obtain bands of different strengths. By way of illustration, and without limiting the scope of this invention in any manner, the following dimensions relate to the most preferred embodiment of the invention.

In the most preferred embodiment, the overall length of the band 10 is approximately 9 inches. The length of each end segment 16 is about 1.2 inches. Accordingly, the length of each long straight edge 12, 14 is about 6.6 inches. The full width of the most preferred band is approximately 2.75 inches. The band 10 is roughly 0.75 inches thick. The long straight edges 12, 14 taper toward the longitudinal axis of the band 10 at an angle of about 30 degrees. The radius of curvature of the concave end portion 18 in the most preferred embodiment is about 0.44 inches as measured from a point laying along the extended longitudinal axis of the band 10 approximately 0.22 inches beyond the end of the band 10. The preferred bushings 22 are 1 inch in diameter, fitting snugly in the mounting holes 20, while the longitudinal slot is about 4.2 inches long and 0.4 inches wide. The surface of the band 10 may be decorated with raised letters in a dished area.

The tension band 10 may be formed by molding, extrusion, milling or other suitable processes well known in the art. Injection molding is preferred, as a better fit and more permanent connection is made between the mounting holes 20 and the bushings 22.

The band 10 is universally adaptable to different makes and models of spring loaded trap machines. Because the bushings can be drilled out and enlarged, almost any spring loaded machine can be quickly and inexpensively converted to a band operated machine merely by selecting appropriate mounting hardware.

Figure 5:
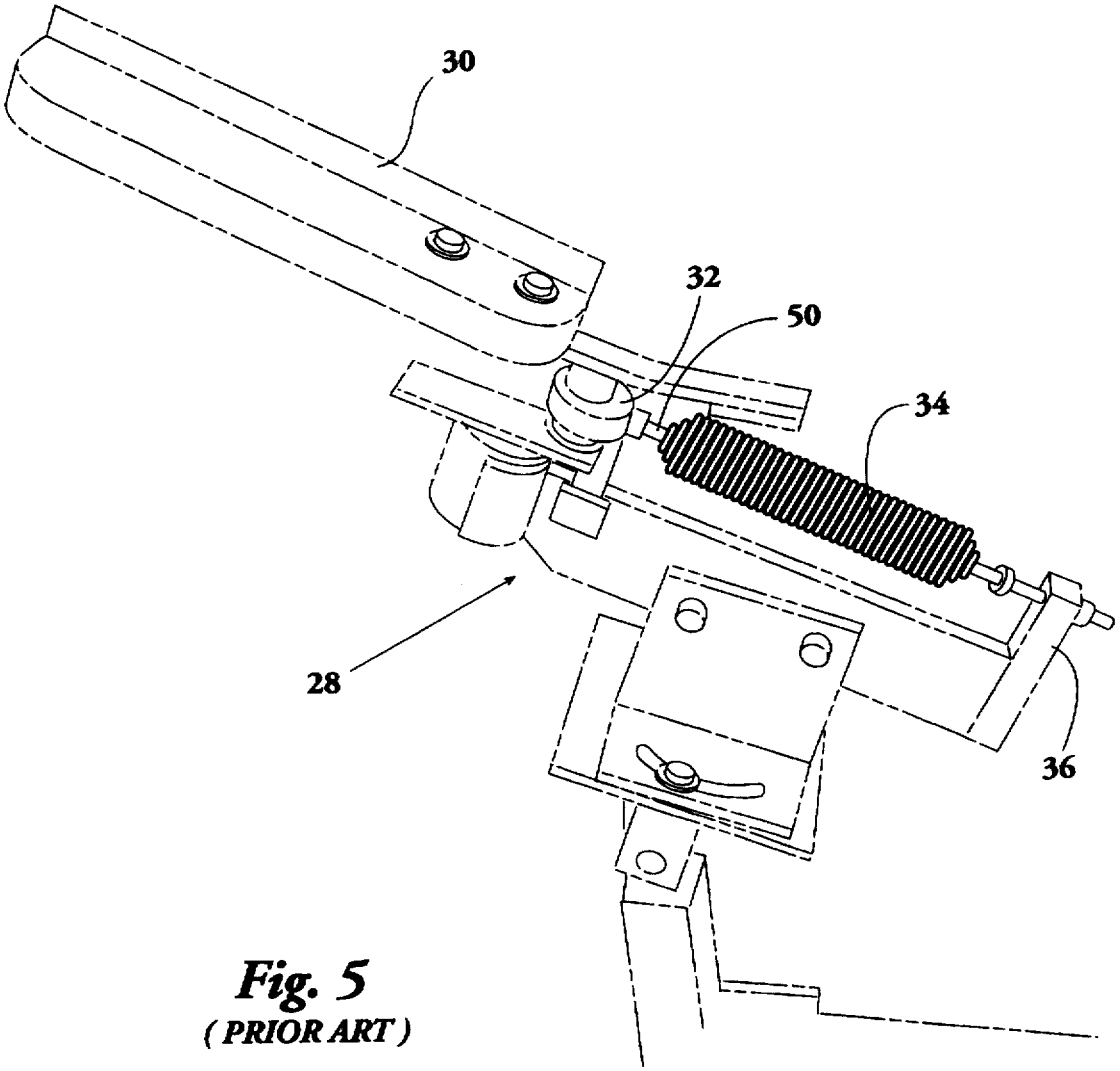
Fig. 5 ( PRIOR ART )
FIG. 5 is a perspective view of a typical spring loaded trap machine.

FIG. 5 shows a typical spring loaded trap machine. The machine, generally indicated by the reference number 28, includes a throw arm 30 and a cam 32. A spring 34 is operatively connected at one end to the cam 32 and at its other end to a frame element 36. Plate, bolt, washer and nut assemblies, along with other well known coupling mechanisms, are used to connect the spring 34 to the cam 32 and the frame element 36. It is typical for at least one of the connections to be an adjustable connection such that the tension on the spring 34 can be changed.

The tension band 10 of the present invention is designed to replace the spring 34 of the spring loaded trap machine. One or more of the tension bands 10 can be easily adapted to supplant the spring 34 without having to make major modifications to other component parts of the trap machine.

Figure 6:
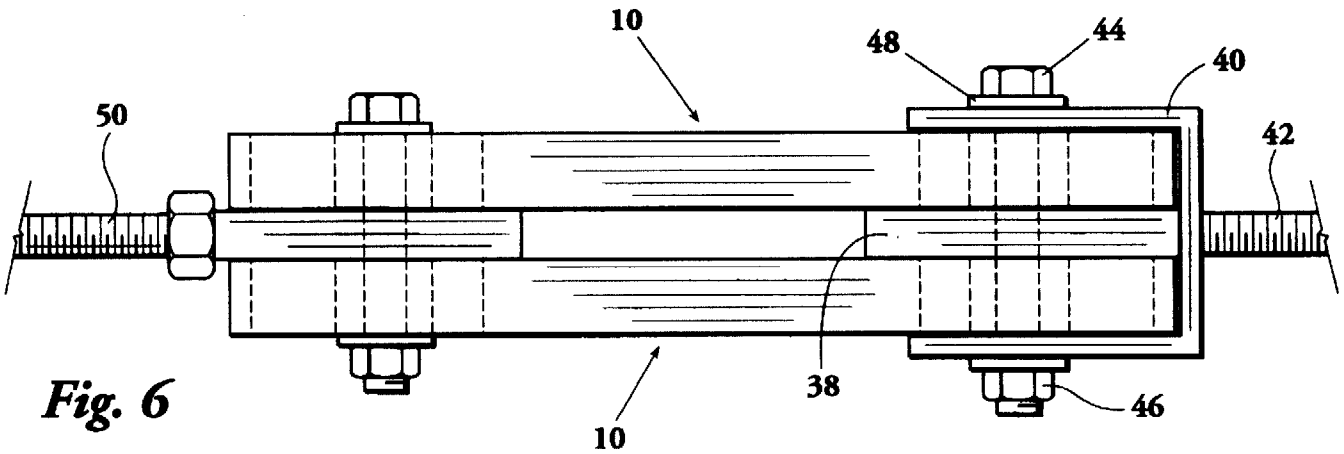
FIG. 6 is an elevational view of two tension bands fastened in tandem by appropriate mounting hardware.

FIG. 6 shows one possible combination of two tension bands 10 connected in tandem with mounting hardware for installation in a trap machine such as that illustrated in FIG. 5. The bands 10 are separated by spacers 38, which may or may not be integral with other components of the mounting assembly. At one end of the bands 10, a yoke 40 is used to couple the bands 10 and provide a surface for the attachment of appropriate hardware, such as a long threaded bolt 42, for installing the bands 10 in the existing mounting assembly of the trap machine. The yoke 40 is channel shaped and has opposing holes that align with the bores 24 of the bushings 22 when properly positioned. A bolt 44 is placed through the holes in the yoke 40 and the bores 24 of the bushings 22 and is tightened with a nut 46 to retain these components in the appropriate spatial relationship. Washers 48 are placed between the head of the bolt 44 and the yoke 40 and between the inner surface of the nut 46 and the yoke 40.

Still with reference to FIG. 6, the opposite ends of the bands 10 are similarly secured with a bolt and nut assembly, although no yoke is utilized. The spacer 38 at this end is affixed, either integrally or such as by welding or other means, to an appropriate coupling device, such as a long bolt 50, specifically selected for its adaptability to the make and model of trap machine being converted.

Figure 7:
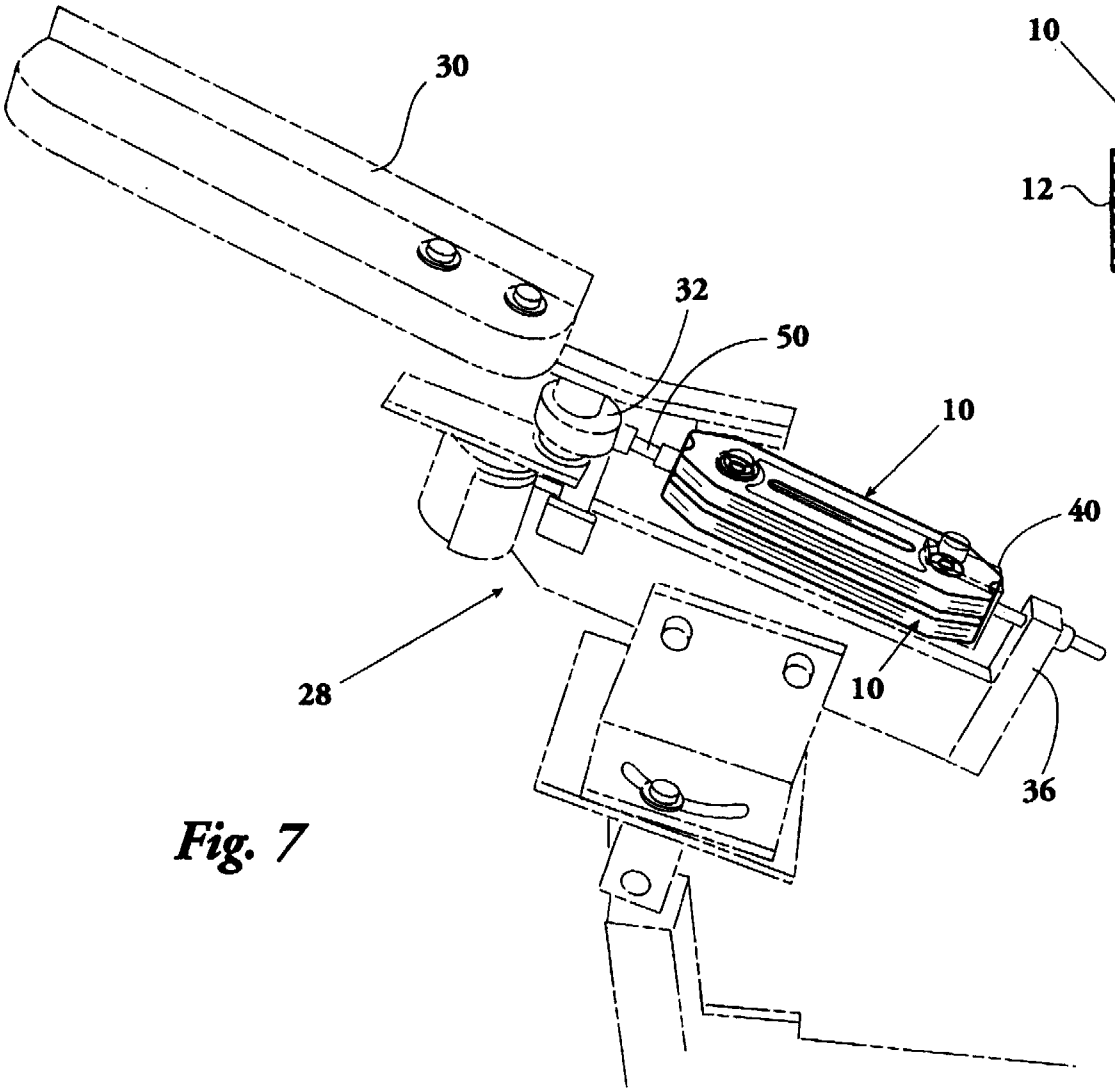
FIG. 7 is a perspective view showing the two tension bands of FIG. 6 installed in place of a spring in the typical spring loaded trap machine of FIG. 5.

Focusing now on FIG. 7, the assembled tandem bands 10 are installed in place of the spring (32 of FIG. 5) as the propulsive element of the trap machine 28. The long bolt 42 extending from the yoke 40 is coupled to the frame element 36 of the trap machine 28 in the same fashion as was the spring. Likewise, the forward long bolt 50 is operatively connected to the cam 32.

Again, it should be appreciated that the mounting hardware is not part of the instant invention and does not limit the invention in any manner. More specifically, the illustration in FIG. 6 of one possible tandem arrangement of bands should not be taken as the sole manner of adapting a band or bands to a trap machine.

A trap machine utilizing the present invention in lieu of a tension spring is operated in the same manner as it originally was, albeit that it will be easier and safer to manage. The throw arm 30 is cocked, either by hand or otherwise, stretching the bands 10, whereupon the clay pigeon(s) is loaded. The trap's triggering mechanism is then actuated to release the bands 10, allowing them to contract and generating the force used to swing the throw arm 30 and propel the clay pigeon.

Whereas, the present invention has been described in relation to the drawings attached hereto, it should be understood that other and further modifications, apart from those shown or suggested herein, may be made within the spirit and scope of this invention.

What is claimed is:

1. A tension band comprising a generally rectangular mass of rubber or an elastomer, said band having a first long edge, a second long edge, a longitudinal axis and two end segments, each said end segment being tapered toward said longitudinal axis and at least one of said end segments having a curvilinear central concave portion formed at the terminal end thereof, a mounting hole being adjacent to said central concave portion.

2. The tension band according to claim 1, wherein each said end segment is tapered toward said longitudinal axis at an angle of 30 degrees.

3. The tension band according to claim 1, wherein said mass has a centrally located longitudinal slot.

4. The tension band according to claim 1, further comprising a bushing seated in said mounting hole, said bushing having a bore extending therethrough.

5. The tension band according to claim 4 wherein said bushing is a hard plastic bushing.

6. The tension band according to claim 4 wherein said bushing is a nylon bushing.

7. The tension band according to claim 4 wherein said bushing is of a diameter larger than that of said bore, such that said bore can be drilled out and enlarged in order to fit different sized mounting hardware.

8. A launching system for providing a propelling force to a throw arm of a trap machine, said launching system comprising at least one tension band operatively connected to said throw arm such as to provide said propelling force to said throw arm, said tension band comprising a generally rectangular mass of rubber or an elastomer, said band having a first long edge, a second long edge, a longitudinal axis and two end segments, each said end segment being tapered toward said longitudinal axis and having a curvilinear central concave portion, a mounting hole being adjacent to said central concave portion.

9. A trap machine comprising at least one throw arm for tossing a clay target and a launching system for providing a propelling force to said throw arm, said launching system comprising at least one tension band operatively connected to said throw arm such as to provide said propelling force to said throw arm, said tension band comprising a generally rectangular mass of rubber or an elastomer, said band having a first long edge, a second long edge, a longitudinal axis and two end segments, each said end segment being tapered toward said longitudinal axis and having a curvilinear central concave portion, a mounting hole being adjacent to said central concave portion.

10. A kit for converting a spring loaded trap machine to a tension band launching technology comprising at least one tension band, said tension band comprising a generally rectangular mass of rubber or an elastomer, said band having a first long edge, a second long edge, a longitudinal axis and two end segments, each said end segment being tapered toward said longitudinal axis and at least one of said end segments having a curvilinear central concave portion formed at the terminal end thereof, a mounting hole being adjacent to said central concave portion.

* * * * *